United States Patent [19]

Mester

[11] 3,939,351

[45] Feb. 17, 1976

[54] THREE-PHASE X-RAY GENERATOR

[75] Inventor: Heinz Mester, Hamburg, Germany

[73] Assignee: U.S. Philips Corporation, New York, N.Y.

[22] Filed: July 15, 1974

[21] Appl. No.: 488,394

[30] Foreign Application Priority Data

July 19, 1973 Germany ..... 2336780

[52] U.S. Cl. ..... 250/402; 250/408; 250/421

[51] Int. Cl.[2] ..... H05G 1/30

[58] Field of Search ..... 250/401, 402, 421, 408

[56] References Cited

UNITED STATES PATENTS 3,636,355 1/1972 James ..... 250/421

*Primary Examiner*—Craig E. Church

*Attorney, Agent, or Firm*—Frank R. Trifari; Ronald L. Drumheller

[57] ABSTRACT

In six-pulse and twelve-pulse X-ray generators, the objectionable ripple at double mains frequency caused by the low thermal inertia of the filament is here cancelled out by an opposing ripple deliberately introduced by unbalancing the three-phase system.

2 Claims, 3 Drawing Figures

THREE-PHASE X-RAY GENERATOR

The invention relates to a three-phase X-ray generator comprising a three-phase transformer having secondary windings which are connected to the X-ray source via a rectifier circuit, the high voltage of the transformer not being smoothed.

The advantage of such a three-phase generator, usually constructed as a six-pulse or twelve-pulse generator, over a single-phase generator is that the tube voltage exhibits substantially less ripple. Consequently, a three-phase generator permits substantially higher loading of the X-ray tube, and a larger fraction of the electric power is converted into X-radiation.

FIG. 1 shows an ideal tube voltage versus time wave form using a twelve-pulse generator. The reference T denotes a cycle of the mains alternating voltage. However, such a wave form of the tube voltage is not achieved in practice, because side-effects occur which produce a substantially larger ripple as shown in FIG. 2, which is undesirable. Particularly disturbing in this respect is a ripple which is superimposed on the high voltage at a frequency twice that of the three-phase current source.

The present invention has for its object to provide a three-phase generator in which this ripple of double mains frequency either does not occur, or is substantially reduced.

It was found that this ripple is caused by variations in the heating of the cathode of the X-ray tube by alternating current. The presently used X-ray tubes have directly heated cathodes with filaments of a diameter so small that the temperature of the filament substantially follows the amplitude of the filament current at alternating currents of mains frequency (50 Hz or 60 Hz). This means that the emission current, and hence also the X-ray tube current, exhibit two maximum values in each cycle of the alternating current through the filament. The X-ray tube current thus modulated causes a voltage drop across the internal resistance of the generator which is in phase-opposition with the filament current. The high voltage on the X-ray tube therefore fluctuates in phase-opposition to the tube current, and at double the frequency of the filament current. This effect can in principle be avoided by applying a current of substantially higher frequency (for example, 150 Hz) to the filament of the X-ray tube. The comparatively slight thermal inertia of the filament is then adequate to prevent the filament temperature from varying significantly with the filament current frequency. However, this solution requires a filament current source of a higher frequency, and is therefore comparatively expensive. A less expensive solution to this problem is provided according to the invention in that in a three-phase X-ray generator of the kind set forth the three-phase transformer has an asymmetrical construction and/or is asymmetrically connected to the three-phase mains and/or to the X-ray source.

The invention is based on the consideration that any unbalancing of the three-phase mains voltages in X-ray generators of the kind set forth causes an alternating voltage of double the mains frequency to be superimposed on the high voltage of the X-ray tube. If this unbalancing is properly formed, this alternating voltage can have the same amplitude as but a opposite phase from that of the alternating voltage produced by the described modulation of the X-ray current. The ripple on the voltage across the X-ray tube which is caused by the latter alternating voltage can thus be compensated for.

The unbalancing means in the three-phase system can in principle consist of a voltage asymmetry and/or a resistance asymmetry. The resistance asymmetry can be formed by different resistors between the mains voltages and the primary windings of the three-phase transformer, or between the secondary winding and the rectifier bridge. The voltage asymmetry can be formed by different voltage transformation ratios or by the application of different voltages to the primary windings of the three-phase transformer. The advantage of the resistance asymmetry is that it is independent of the tube power or the tube current, respectively. This is because the ripple caused by the modulation of the filament current with double the mains frequency is larger as the tube current is larger; the same applies to the ripple of the high voltage which is in phase-opposition and which is caused by the resistance asymmetry, so that compensation is feasible for all currents or powers by the suitable proportioning of the asymmetry of the three-phase system.

In a preferred embodiment according to the invention, the resistance asymmetry is particularly advantageously realized by the use of mains matching resistors of different value. Such mains matching resistors are already present in practically all generators any way in order to enable adaptation of the three-phase generator to different mains resistances.

One embodiment according to the invention will now be described in detail with reference to the drawings, in which.

Figure 1:
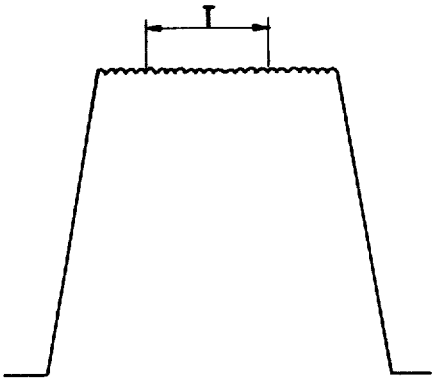
FIG. 1 is an ideal tube voltage waveform.
Figure 2:
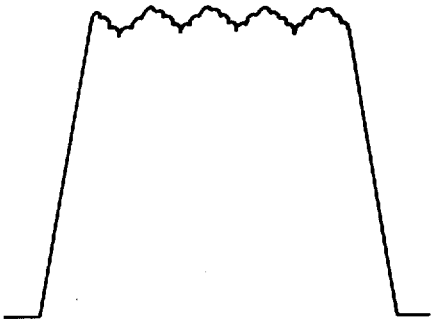
FIG. 2 is a tube voltage waveform having ripple at double mains frequency.
Figure 3:
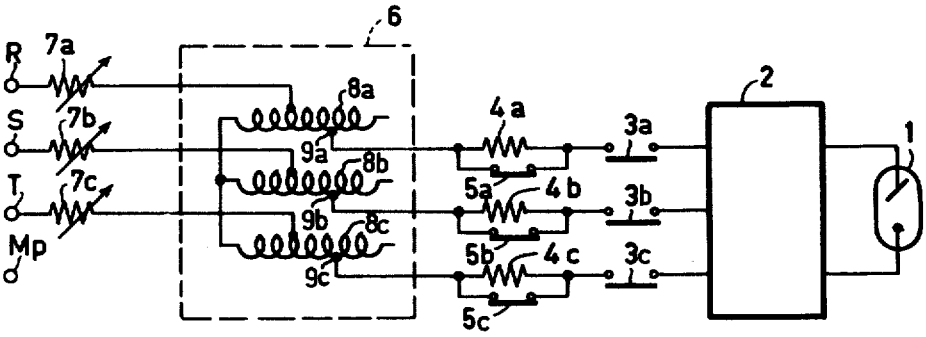
FIG. 3 is a diagrammatic representation of a preferred circuit arrangement according to this invention.

The terminals R, S, T of a three-phase mains are successively connected, via adjustable mains matching resistors 7*a*, 7*b*, 7*c*, to windings 8*a*, 8*b* and 8*c* of an autotransformer 6 which serves for the adjustment of the primary voltage of a three-phase transformer 2. Secondary windings 9*a*, 9*b* and 9*c* of the autotransformer 6 are successively connected, via resistors 4*a*, 4*b* and 4*c* which can be short-circuited by contacts 5*a*, 5*b* and 5*c*, and contacts 3*a*, 3*b* and 3*c*, to the known three-phase transformer and rectifier circuit 2.

In order to compensate for the voltage drop which occurs when use is made of a power supply with a decreasing load, the voltages generated in the secondary windings of the autotransformer are applied to the primary windings of the three-phase transformer and rectifier circuit 2 which is not shown in detail.

The contacts 3*a*, 3*b*, 3*c* are then operated by a time switch not shown. The secondary windings of the three-phase transformer in circuit 2 are connected in known manner to the X-ray tube 1 via a three-phase bridge rectifier which is also in circuit 2. Consequently, during an exposure a pulsating direct voltage, comprising 6 or 12 pulses per cycle of the alternating mains voltage, depending on the connection of the three-phase transformer, is applied across the X-ray tube 1. The X-ray generator described thus far is of a generally known type.

In known X-ray generators the mains matching resistors 7*a*, 7*b* and 7*c* are proportioned such that the same internal resistance exists on the secondary side of the high voltage winding for each phase, but according to the invention these resistors are of different value such that the internal resistance of the three-phase generator varies at double the mains frequency and hence at the same frequency with which the tube current is modulated. An optimum choice of the phase of the filament alternating current ensures that it is sufficient to vary only one of the mains matching resistors 7*a*, 7*b*, 7*c*. Using identical resistors, one of the resistors can be varied until optimum phase matching is empirically achieved.

Instead of the mains matching resistors 7*a*, 7*b*, 7*c*, the resistors 4*a*, 4*b*, 4*c* can alternatively be asymmetrically constructed. These resistors serve to compensate for the voltage transient occurring in the case of a stepwise decreasing tube current. The voltage-asymmetry method described in the preamble can thus be realized by the asymmetrical construction of the resistor series 4*A*, 4*b*, 4*c*.

What is claimed is:

1. Circuit means for reducing ripple at double mains frequency in the high voltage of an X-ray tube, said ripple resulting from variations in emission current due to temperature variations of the filament of said tube when the filament current is alternating current of mains frequency, said circuit means comprising a three-phase transformer and rectifier circuit means connected to an X-ray tube for converting three-phase mains voltages into an unsmoothed high voltage for the X-ray tube and unbalancing means for inducing a ripple on said high voltage at double mains frequency so as to cancel the ripple induced by the temperature variations of the filament.

2. A circuit means as defined in claim 1 wherein said unbalancing means comprises resistances adapted for connecting three phase mains voltages to said three phase transformer and rectifier circuit, said resistances not being equal in order to create an unbalance.

* * * * *